United States Patent [19]

Truskolaski

[11] Patent Number: 4,713,267

[45] **Date of Patent: * Dec. 15, 1987**

[54] DECORATIVE RIBBON AND SHEET MATERIAL

[75] Inventor: Bernard S. Truskolaski, Lake Elmo, Minn.

[73] Assignee: Minnesota Mining and Manufacturing Company, St. Paul, Minn.

[ * ] Notice: The portion of the term of this patent subsequent to Jan. 6, 2004 has been disclaimed.

[21] Appl. No.: 855,002

[22] Filed: Apr. 22, 1986

Related U.S. Application Data

[63] Continuation-in-part of Ser. No. 722,233, Apr. 15, 1985, abandoned.

[51] Int. Cl.[4] ..... D04D 7/10

[52] U.S. Cl. ..... 428/4; 156/178; 156/181; 223/46; 428/114; 428/286

[58] Field of Search ..... 156/178, 181; 223/46; 428/4, 5, 114, 286, 294, 284

[56] References Cited

U.S. PATENT DOCUMENTS

| | | | |
|---|---|---|---|
| 2,626,883 | 1/1953 | Boese | 428/290 |
| 3,449,187 | 6/1969 | Bobkowicz | 428/294 X |
| 3,637,455 | 1/1972 | Pearson et al. | 428/4 |
| 3,676,277 | 7/1972 | Truskolaski | 428/4 |
| 4,164,600 | 8/1979 | Yung et al. | 428/373 X |
| 4,329,382 | 5/1982 | Truskolaski et al. | 428/4 |
| 4,374,894 | 2/1983 | Antlfinger | 428/288 |
| 4,449,652 | 5/1984 | Coppins et al. | 428/4 X |
| 4,473,611 | 9/1984 | Haq | 428/198 |
| 4,476,168 | 10/1984 | Aoyama | 428/4 |
| 4,490,427 | 12/1984 | Grant et al. | 428/107 |
| 4,585,676 | 4/1986 | De Smet et al. | 428/5 |
| 4,634,612 | 1/1987 | Nelson et al. | 428/4 |

OTHER PUBLICATIONS

Pages 1539–1541, of The American Heritage Dictionary—Scecond College edition Houghton mifflin Company Boston, Mass. copyright 1982.

Pages 19–21 to 30 of "Ultrasonic Plastics Assembly", Branson Ultrasonic Corporation 1979, Printed in U.S.A.

*Primary Examiner*—Henry F. Epstein

*Attorney, Agent, or Firm*—D. M. Sell; J. A. Smith; C. Truesdale

[57] ABSTRACT

Decorative sheet material is provided. The sheet material has a thermally bonded nonwoven tissue-like base layer having a web of 20 to 90 weight percent thermally bondable polymeric staple fibers and 10 to 80 weight percent rayon staple fibers and 5 to 50 weight percent thermobonding resin based on the weight of the web, and at least a monolayer of a multiplicity of substantially parallel continuous multifilament acetate yarns substantially covering a first side of said base layer and thermally laminated to said base layer. The second side of said base layer is sufficiently sonically sealable to a base layer of a second sheet material to form durable ribbon asemblies.

24 Claims, 10 Drawing Figures

DECORATIVE RIBBON AND SHEET MATERIAL

This application is a continuation-in-part of U.S. patent application Ser. No. 722,233, filed Apr. 15, 1985, now abandoned.

BACKGROUND OF THE INVENTION

1. Field of the Invention

This invention relates to decorative sheet material, a process for producing decorative sheet material, and to products, such as ribbon, pressure-sensitive adhesive tape, laminated products, embossed products and molded products, produced therefrom.

2. Description of the Background Art

The three primary types of decorative ribbon in widespread use today are woven yarn-based ribbon, nonwoven yarn-based ribbon, and foamed, oriented, polypropylene-based ribbon.

The woven yarn-based ribbons are generally the finest ribbons in terms of yarn-like luster, texture, feel, and quality of color. Although the quality of such ribbon is high, manufacturing costs are also relatively high.

The foamed, oriented, polypropylene-based ribbons generally do not offer the aesthetics obtainable with the woven yarn-based ribbons, since these ribbons are generally stiff and have a plastic-appearing surface rather than the yarn-like luster of the woven yarn-based ribbons. An advantage found in these polypropylene-based ribbons is that they can be thermally welded, e.g., by sonic sealing, to form ribbon assemblies, such as those described in U.S. Pat. Nos. 3,637,455 and 4,329,382.

Nonwoven yarn-based ribbons, such as described in U.S. Pat. No. 2,626,883, possess the excellent aesthetics of yarn-like luster, texture, feel, and quality of color found in woven yarn-based ribbons, and can be manufactured much less expensively than the woven yarn-based ribbons. The ribbon described in U.S. Pat. No. 2,626,883 has a tissue-like web of staple viscose rayon fibers and plasticized staple acetate rayon fibers autogenously interbonded at their crossing points to form a network. A monolayer of aligned yarns of non-plasticized continuous acetate rayon filaments is autogenously bonded onto one face of the web of the plasticized acetate rayon fibers.

This composite is impregnated by sizing that superficially coats the yarns. Although the aesthetics of this nonwoven yarn-based ribbon are excellent and manufacturing expenses are less than for producing the woven yarn-based ribbon, deficiencies in the nonwoven yarn-based ribbon are present. The volatile plasticizer used on the staple acetate rayon fibers is costly and requires the use of expensive processing equipment such as oven filter scrubbers. Additionally, such ribbon cannot be sufficiently sonically bonded to form durable ribbon assemblies, but must be bonded by applying adhesive to the areas to be bonded, a method generally more difficult to control than thermal bonding.

U.S. Pat. No. 4,490,427 (Grant et al.) discloses thermally adhesive webs. The webs have substantially parallel fusible polymeric filaments thermally bonded to and interconnected by randomly arranged polymeric fibers. The parallel filaments generally have a diameter substantially greater than the diameter of the interconnecting filaments and adjacent parallel filaments are generally spaced apart 0.5 to 5 mm. Although such a web is thermally adhesive, the web does not possess the aesthetics desired for decorative ribbon and sheet material.

The present invention provides a decorative sheet material which has the excellent aesthetics of the nonwoven yarn-based ribbon material and thermal sealability of the polypropylene film-based ribbons.

SUMMARY OF THE INVENTION

The present invention provides decorative sheet material which has a thermally bonded nonwoven tissue-like base layer of (i) a staple fiber web of 20 to 90 weight percent thermally bondable polymeric staple fibers and 10 to 80 weight percent rayon staple fibers, and (ii) 5 to 50 weight percent thermobonding resin based on the weight of the web. Thermally laminated to the base layer is a multiplicity of substantially parallel continuous multifilament acetate yarns which substantially cover one side of the base layer. An optional protective sizing layer may be applied over the multifilament yarns. The sheet material can be dyed or printed to achieve desired coloration or a metallic finish can be applied to the acetate yarn surface, e.g., by vapor deposition, to achieve desired surface effects. The base layer side of the decorative sheet material is heat sealable to fibrous substrates. Such heat sealability permits the sheet material to be sonically welded to form ribbon assemblies and to be directly laminated to fibrous substrates. The decorative sheet material is also thermally formable and can be molded or embossed.

The present invention also provides a process for producing the decorative sheet material. A tissue-like nonwoven web of the polymeric and rayon staple fibers is formed. The web is coated with a solution of thermally bondable resin and dried to form a base layer. A multiplicity of rayon acetate multifilament yarns are laid on the base layer in close parallel arrangement to substantially cover the surface of one side of the base layer and are bonded to the base layer by heating the yarn covered base layer under sufficient temperature and pressure to effect bonding.

The present invention further provides products produced from the decorative sheet material. The sheet material can be slit to form ribbon. The ribbon is particularly useful in ribbon assemblies because it can be sonically welded. The sheet material can be coated with a pressure-sensitive adhesive to provide pressure-sensitive adhesive material. The sheet material can be thermally bonded to fibrous substrates, for example, paper stock, to provide decorative products such as matchbook covers, greeting cards, and boxes. The decorative sheet product can be molded to form interesting and decorative shapes and adornments. The decorative sheet product can be embossed to modify the acetate filament surface, thereby providing a woven fabric appearance.

DETAILED DESCRIPTION OF THE INVENTION

Figure 1:
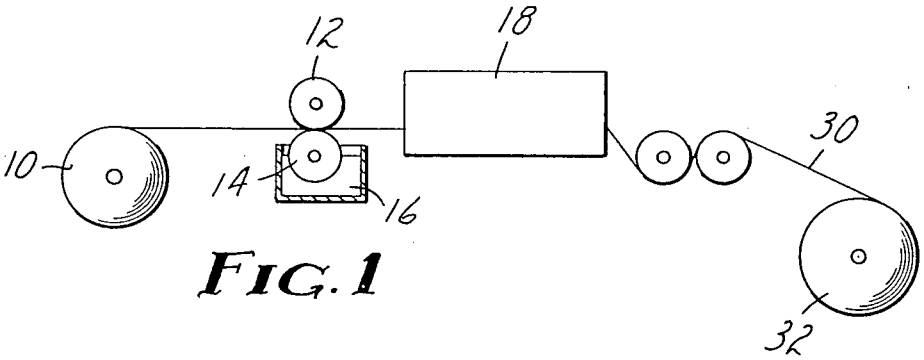
FIG. 1 is a schematic diagram of an apparatus which can be used for producing the base layer of the sheet material according to the invention.

The decorative sheet material of the invention has a thermally bonded tissue-like base layer of thermally bondable polymeric staple binder fibers (hereinafter "binder fibers"), viscose rayon staple fibers (hereinafter "rayon fibers", and thermobonding resin. Thermally adhered to this base layer is at least a monolayer of substantially parallel, continuous, multifilament acetate yarns.

The primary function of the thermally bondable polymeric staple binder fibers is to provide the sheet material with heat sealability. The term "heat sealability" means that the base layer side of the sheet material can be fused to various fibrous substrates, such as a second sheet material, paper stock, cardboard, or tissue paper, by such heat sealing means as heated rolls, heat guns, sonic sealers, lasers, hot wheel-type sealers and laminators. The binder fibers also aid in bonding the base layer together and in bonding the acetate filament yarns to the base layer. The binder fibers have at least an outer portion which is bondable, i.e., meltable or fusable, when subjected to thermal energy such as may be provided by heat, sonic, or laser energy sources.

The temperature at which at least the outer portion of the binder fibers melt is preferably in the range of about 225° to 400° F. (110° C. to 200° C.), more preferably 225° to 250° F. (110° C. to 125° C.). The binder fibers can be of any polymeric fiber forming material such as polyester, polyamide, polyolefin, or combinations thereof provided that at least the outer portion is thermally bondable. Preferred binder fibers are of the core-and-sheath-type, having a sheath which melts to form bonds at the desired temperature and a core which melts at a temperature at least 50° F. (30° C.) above the melting temperature of the sheath. The higher melting core provides strength to the base layer and thus to the final sheet material.

The binder fibers preferably have a staple length of ¼ to 6 inches (0.6 to 15 cm), more preferably 1 to 3 inches (2.5 to 7.5 cm). Fibers which are too long may be difficult to process, e.g., to form a sufficiently intimate blend with the rayon fibers. The binder fibers preferably have a denier in the range of 0.5 to 10 denier, more preferably 1 to 6 denier. The finer denier fibers generally provide greater softness to the sheet material. Of course, the binder fibers can be of a combination of different lengths and/or deniers to achieve a desired balance of properties.

The binder fibers should be present in the base layer in an amount of about 20 to 90 weight percent, preferably 60 to 85 weight percent, more preferably 70 to 80 weight percent base on the total staple fiber weight to provide the sheet material with suitable heat sealability. When the binder fibers are present in amounts less than about 20 weight percent, sufficient heat sealability is not provided in the sheet material. When the binder fibers are present in amounts greater than about 90 weight percent, the uniformity of the blend of the binder fibers and the rayon fibers may be reduced as well as the uniformity and absorption of the thermobonding resin.

The rayon fibers provide the sheet material with pliability, aid in uniformity of the base layer, i.e., fiber and resin distribution, and enhance the dyeability of the base layer. The rayon fibers preferably have a staple length of ¼ to 6 inches (0.6 to 15 cm), more preferably 1 to 3 inches (2.5 to 7.5 cm). The length of the rayon fibers is preferably similar to that of the binder fibers to aid in uniformity of blending the staple fibers. The rayon fibers preferably have a denier in the range of 0.5 to 10 denier, more preferably 1 to 3 denier. The lower denier fibers generally provide better uniformity of binding resin and coloration.

The rayon fibers should be present in the base layer in an amount of 10 to 80 weight percent, preferably 15 to 40 weight percent, more preferably 20 to 30 weight percent, based on the total staple fiber weight, to provide pliability to the sheet material and to enhance the aesthetics of the sheet material.

The thermobonding resin provides adhesion between the base layer and the multifilament acetate yarns as well as providing adhesion between the fibers of the staple fiber web. The thermobonding resin can be any resin which will effect bonding between the base layer and the acetate yarns when subjected to pressures in the range of between about 40 and 100 lb/in (7 and 18 kg/cm) width and temperatures in the range of between about 225° and 400° F. (110° C. and 200° C.). Examples of such thermobonding resins include acrylic resins, vinyl acrylic resins, styrene acrylic resins, ethylene vinyl acetate resins, and polyvinyl acetate resins. Commercially available thermobonding resins include "X-Line" 2833 vinyl acrylic resin, "Dur-O-Set" 78-3990 styrene acrylic resin, and "Dur-O-Set" E-669 ethylene vinyl acetate resin, available from National Starch and Chemical Corp., NW 1715 acrylic styrene resin and "Rhoplex" P-376 acrylate resin, available from Rohm and Haas Company, "Airflex" 131 ethylene-vinyl chloride resin, available from Air Products and Chemicals, Inc., and "Gelva" TS-30 vinyl acetate resin, available from Monsanto Company.

The thermobonding resin is used in an amount of 5 to 50 weight percent, preferably 15 to 30 weight percent, based on the weight of the staple fiber in the base layer. Where less than 10 weight percent of the thermobonding resin is present, inadequate bonding between the acetate filament yarns and the base layer can occur. Where the thermobonding resin is used in an amount greater than 50 weight percent, excessive bleed-through into the acetate filament yarns may occur, diminishing the aesthetics of the sheet material. The thermobonding resin can be applied to the base layer by well-known methods such as spraying, dipping, and roll application.

The continuous multifilament acetate yarns which are thermally adhered to the base layer by the thermobonding resin and the binder fibers through the action of heat and pressure, provide a satin-like, high sheen surface. The acetate yarns are substantially parallel, aligned along the length of the sheet surface, and substantially cover one side of the base layer. The acetate yarns are preferably uncrimped and untwisted to obtain maximum sheen where such surface character is desired. The acetate yarns preferably have a denier/filament in the range of between about 1 and 10, more preferably 3 and 5. The finer the denier/filament, the more satin-like the surface becomes. Total denier of the continuous filament acetate yarns can range between 50 and 2500. The term "filament yarn" as used herein includes filament tow which can be spread to cover the base layer.

The relative amounts of base layer and acetate filament yarn depend on the characteristics desired for particular end uses. Generally, the base layer has a weight in the range of about 17 to 42 g/m$^2$ when the sheet material is to be used for molding or laminating, about 25 to 42 g/m$^2$ when the sheet material is to be used in decorative pressure-sensitive adhesive tape, and about (23 to 30 g/m$^2$), when the sheet material is to be used in decorative ribbon. Generally, the acetate filament yarn is provided in an amount of (30 to 84 g/m$^2$). The amount of acetate filament yarn is also dependent on the denier of the yarn. Where less pliability is required, as for molding and laminating, higher denier/filament yarns can be used, resulting in greater filament yarn weight per unit area. Where greater pliability is required, as in decorative ribbon, lower denier/filament yarns, e.g., 4 denier per filament or less, can be used, resulting in less filament yarn weight per unit area.

The sheet material can optionally have a protective coating of sizing applied to the laminated sheet material to prevent fuzziness of the acetate yarn surface during additional processing steps such as cutting, slitting, and molding or during use. Suitable sizing materials include vinyl resins, "Ucar" VYHH, "Ucar" VMCH, available from Union Carbide Corp., and "Gelva" 264 available from Monsanto Company. The sizing is generally applied to the sheet material as a superficial coating which does not substantially penetrate the sheet material or serve to adhere the acetate filaments together. Generally the amount of sizing is in the range of about 1 to 10 weight percent based on the weight of the material.

The sheet material may also optionally be dyed to impart the desired coloration for decorative end uses. The dyes selected are preferably those which dye the rayon fiber and the acetate yarn as well as provide color to the binder fiber, thermobonding resin and sizing. Metallic surfaces can be provided, such as by vapor-deposition of aluminum or copper onto the acetate filament surface.

Figure 2:
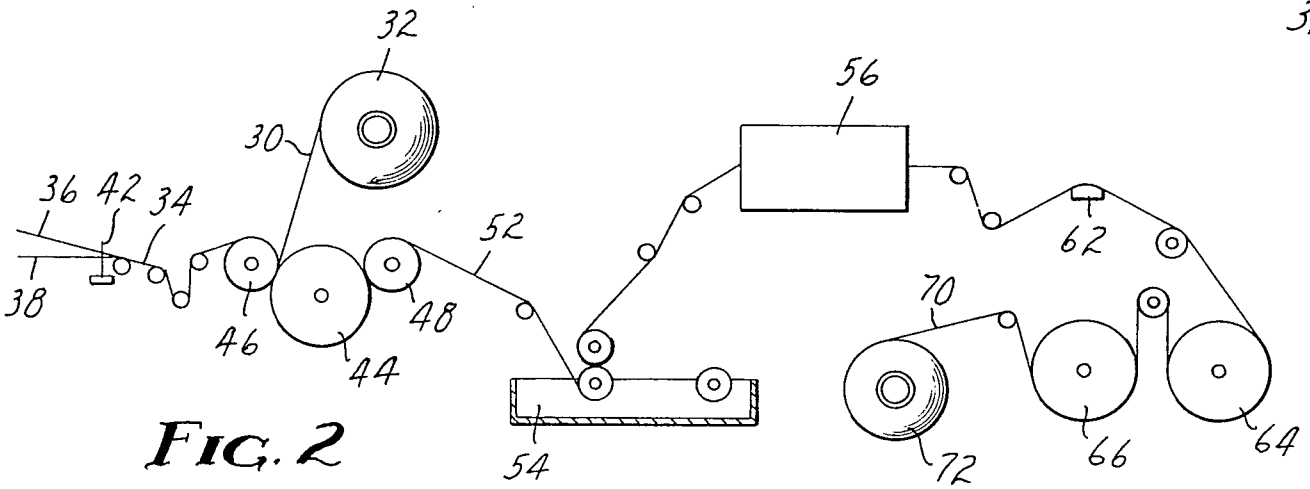
FIG. 2 is a schematic diagram of an apparatus which can be used for applying the acetate filament yarns to the base layer according to the invention.

Referring to FIGS. 1 and 2, which show apparatus suitable for producing the sheet material of the invention, a web 10 of binder fibers and viscose rayon fibers is formed by a blending and web forming apparatus (not shown), such as a carding machine, a Garnett machine, or a "Rando-Webber" manufactured by Curlator Corp. The web 10 is passed between rotogravure nip rolls 12 and 14. Roll 14 rotates through a bath 16 containing an aqueous solution of thermobonding resin and then contacts web 10 to effect application of the thermobonding resin to web 10. The resin impregnated web passes through drying oven 18 to dry the web. The dried web 30 which is the base layer of the sheet material can then be wound on wind-up roll 32.

To complete making the sheet material, acetate filament yarns 34 of warps 36 and 38 are supplied through condensing comb 42 and are brought in contact with resin impregnated web 30 at heated laminating drum 44 to effect thermal bonding of the acetate filament yarns 34 to the base layer 30. The temperature of laminating drum 44 should be sufficient to effect thermal bonding between the components of the sheet material. Where the binder fibers are of the sheath and core type, the temperature should not be so high as to melt the fiber core. Drum 44 preferably is provided with a release surface, such as Teflon® film, to prevent adhesion of base layer 30 thereto. The acetate filament yarns and the web pass between laminating drum 44 and press rolls 46 and 48 which press the acetate filament yarns against base layer 30. Press rolls 46 and 48 preferably have a soft, resilient surface to permit contacting the filament yarns with the base layer without forcing the filaments into the layer to such an extent that the satin-like appearance provided by the filament yarns is lost.

Figure 3:
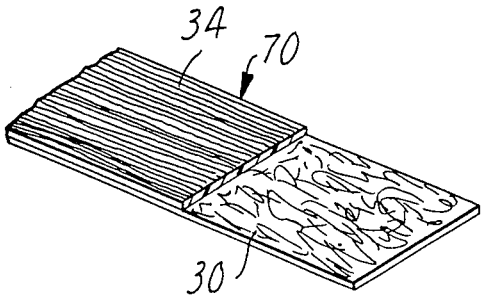
FIG. 3 is a schematic cut-away perspective view of sheet material according to the invention.

The laminated sheet material 52 can then optionally be passed through bath 54 which contains sizing and/or dye solution and dried in drying oven 56. The sheet material is passed over anti-wrinkle slat 62 and heated ironing drums 64 and 66 to smooth the sheet material. The finished smooth sheet material 70 can then be wound on roll 72. As shown in FIG. 3, the finished sheet material 70 has acetate filament yarns 34 laminated to base layer 30.

Figure 4:
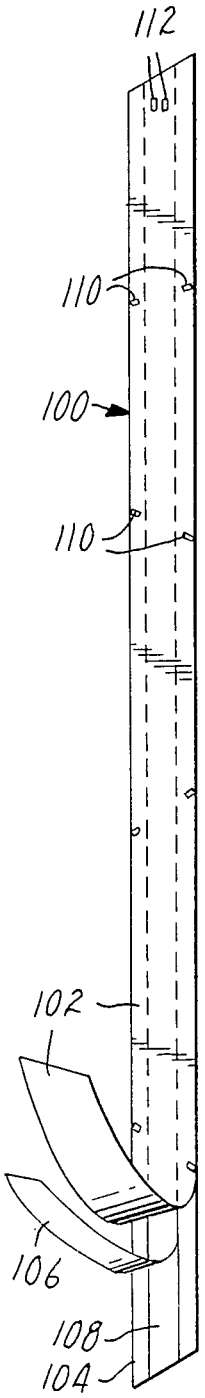
FIG. 4 is a front plan view of a ribbon assembly according to the invention.

The sheet material can be slit to form ribbon which may be packaged as rolls of ribbon or used to produce ribbon assemblies 100 as shown in FIG. 4 such as 3M Bow Magic™ Brand Bows and the ribbon assemblies disclosed in U.S. Pat. No. 4,329,382 which is incorporated herein by reference. The sheet material is particularly suited for ribbon and ribbon assemblies because the acetate filament yarns provide a rich lustrous face surface while the base layer provides a surface with sufficient texture to inhibit tied knots and formed bows of such ribbon from sliding apart.

Ribbon assemblies are generally formed from four layers of sheet material slit to ribbon width, outer members 102 and 104 and inner members 106 and 108, each member being of substantially the same length. A single inner member may be used, although two inner members are generally preferred. Inner members 106 and 108 are narrower than outer members 102 and 104 and are arranged such that they are spaced from the edges of outer members 102 and 104. Outer members 102 and 104 are usually of substantially the same width. The base layers of the sheet material of inner members 106 and 108 are in face to face contact. The base layers of the sheet material of outer members 102 and 104 are in contact with the acetate filament surface of inner members 106 and 108. Outer member 102 is intermittantly bonded to outer member 104 at points of attachment 110. All four members of the ribbon assembly are bonded together near an end portion thereof by end seal 112. The sheet material is particularly useful for ribbon assemblies because the points of attachment 110 and end seals 112 can be heat-sealed such as by sonically welding. Where the points of attachment 110 are formed by direct contact of the sheet material with a heat source, the base layers being in face to face contact, the direct contact of the heat source is with the acetate filament surface. This minimizes adherence of the heat source to the sheet material and causes the heat to be isolated in the area of the seal rather than dissipating across the sheet material.

Figure 5:
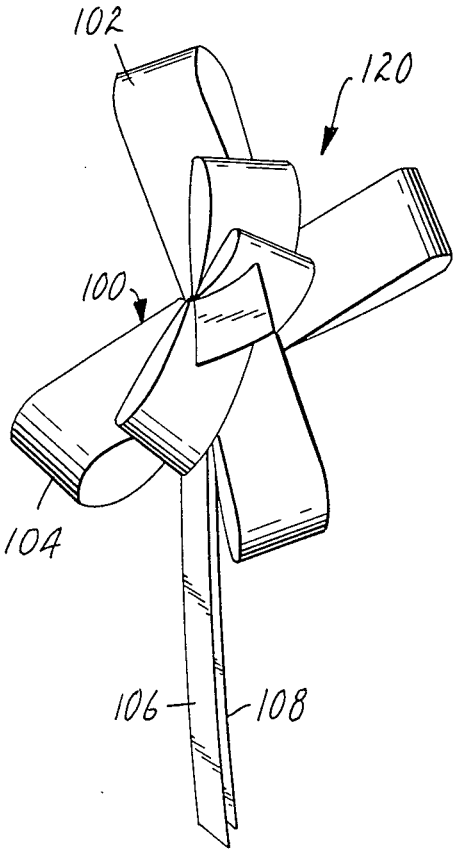
FIG. 5 is a perspective view of a bow formed from the ribbon assembly of FIG. 4.

The ribbon assemblies 100 are useful for forming decorative bows 120 as shown in FIG. 5. Decorative bow 120 is formed from ribbon assembly 100 by sliding the ends of outer members 102 and 104 distant from end seal 112 toward end seal 112 over inner members 106 and 108 such that outer members 102 and 104 form bow 120 with inner members 106 and 108 extending therefrom. The shape of bow 120 is determined by the spacing of points of attachment 110 in the ribbon assembly. The sheet material is particularly suited for use in such decorative bows because the base layers of one member of a ribbon assembly can be sonically sealed to another member such that the sealed points of attachment have a peel value of at least about 14 oz (397 g), preferably at least about 16 oz (454 g), more preferably at least about 18 oz (510 g). The peel value is determined by clamping the end of one member in a jaw of a tensile tester, and clamping the end of the other member in the other jaw of the tensile tester and pulling the seal apart at the point of attachment at a rate of 12 in/min (30 cm/min). A peel value of at least about 14 oz (397 g) is necessary to ensure that the seals have sufficient integrity to maintain the decorative bow in the desired shape.

Figure 6:
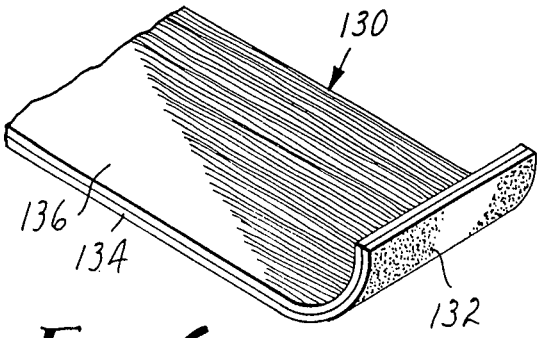
FIG. 6 is a perspective view of a pressure-sensitive adhesive tape according to the invention.

A decorative pressure-sensitive adhesive tape 130, as shown in FIG. 6, can be produced from the sheet material. Such tapes can be produced by applying conventional pressure-sensitive adhesive 132 to the surface of the base layer 134 of the sheet material, the acetate filament surface 136 of the sheet material being on the surface opposed to that having the adhesive applied thereto. Suitable adhesives include those which can be applied and dried at a temperature less than the softening temperature of the binder fiber and the resin. Examples of suitable adhesives include transfer adhesives and hot melt adhesives.

Figure 7:
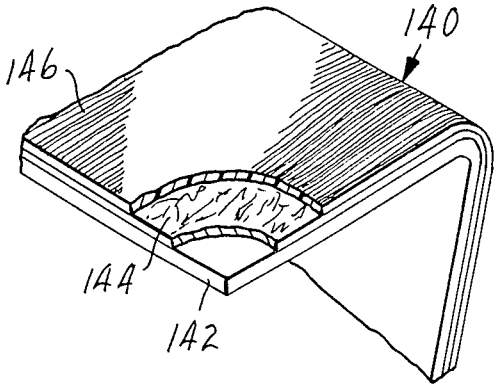
FIG. 7 is a cut-away perspective view of a laminated article according to the invention.

The sheet material can also be laminated to fibrous substrates to form laminated decorative articles 140, such as matchbook covers and card stock, as shown in FIG. 7. The base layer 142 of the sheet material is brought in contact with the fibrous substrate 144 and the composite is heated under sufficient pressure, e.g., 50 to 150 psi (3.5 to 10.5 kg/cm$^2$), at a temperature sufficient to effect bonding between the sheet material and the substrate, generally about the same temperature used to laminate the acetate filament yarn to the base layer. The pressure and temperature should not be so high as to cause damage to the acetate yarn surface 146.

Figure 8:
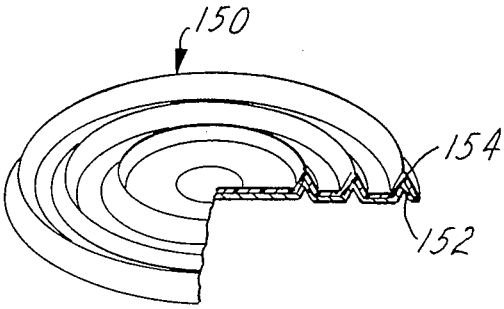
FIG. 8 is a cut-away perspective view of a molded article according to the invention.

The sheet material can be molded to form decorative shaped articles 150, as shown in FIG. 8, due to the thermoformability of the sheet material provided by the binder fibers and the thermobonding resin. The sheet material can be molded at pressures in the range of about 1 to 2 atmospheres and at a temperature sufficient to soften the base layer 152 of the sheet material, generally about the same temperature used to laminate the acetate filament yarn 154 to the base layer 152.

Figure 9:
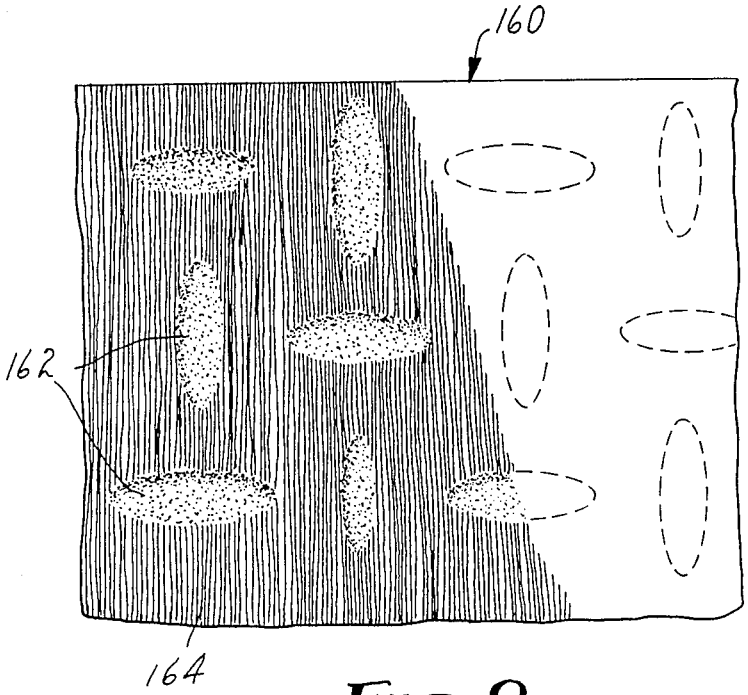
FIG. 9 is a top plan view, greatly enlarged, of embossed sheet material according to the invention.

The sheet material can also be embossed under heat and pressure, to give various surface patterns and effects by modifying the surface appearance of the acetate filament face of the sheet material. For example, by proper selection of the embossing pattern the acetate filament yarn surface can have the appearance of a woven or knitted fabric. FIG. 9 shows the embossed surface of sheet material 160, greatly enlarged, produced by pressing heated window screening material into the surface resulting in embossed areas 162 imposed on the filament surface 164. In the embossed areas, the filaments are pressed into the base layer and are less visible, while in the unembossed areas the filament yarn character remains on the surface of the sheet material. Such embossed sheet material has the appearance of woven fabric. Known embossing methods, such as embossing presses and embossing rolls, can be used to modify the surface. The sheet material should be heated to a temperature sufficient to soften the base layer of the sheet material during embossing.

Figure 10:
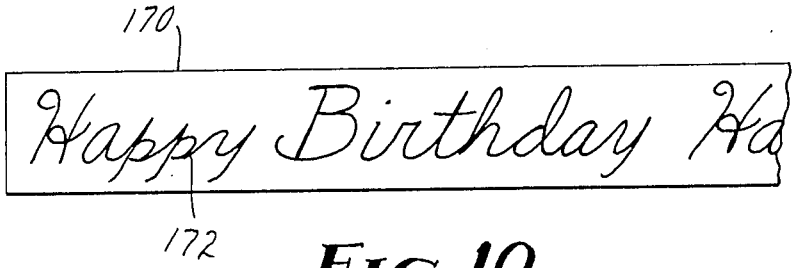
FIG. 10 is a top plan view of printed sheet material according to the invention.

The sheet material 170 can be printed to further enhance the decorative surface. As shown in FIG. 10 slit ribbon can be printed with congratulatory or seasonal messages 172. Sheet material wide goods can be printed to provide products such as wall coverings. Protective coatings such as vinyl resins can be applied to the printed acetate filament surface to provide washability and to provide protection from damage due to environmental sources such as dirt and water.

EXAMPLE 1

Sheet material was prepared using equipment similar to that shown in FIGS. 1 and 2. A web was formed using a Garnett machine, the web containing 75 weight percent polyester binder fiber (4 denier, 1¼ inch (3.2 cm) length, "Melty" brand, available from Unitika, Ltd., Japan) and 25 weight percent viscose rayon (1.5 denier, 1 9/16 inch (4.0 cm) length, type bright, available from American Enka). The web weight was 30 g/m$^2$.

The web was coated with an aqueous solution containing 20 weight percent solids thermobonding resin ("Rhoplex" P-376, available from Rohm and Haas Company) and dried at 250° F. (120° C.) for 46 seconds to produce the base layer. The base layer contained 25 weight percent resin based on the weight of the staple fiber web.

Acetate yarns (320 denier/90 filament/0 twist, type 3T-E000 bright, available from Celanese) were supplied from a warp beam through a comb at 42 ends/inch. The acetate yarns were brought into contact with the coated web at the laminating drum and the acetate yarns were laminated to the coated web using a laminating drum temperature of 380° F. (193° C.), a contact time of 1 second, and 80 lb per inch (14 kg/cm) width exerted by the pressing rolls.

The laminated sheet material was then passed through a sizing/dye bath containing:

5% Gelva 264 vinyl resin (available from Monsanto Company)
0.0006% Astrazon Violet F 3RL (available from Mobay Chemical Corp.)
0.004% Intertherm Scarlet P-356 (available from Crompton and Knowles)
0.0005% citric acid
94.9% ethanol The solids pick-up with the dye and resin sizing contributed about 1.7 g/m$^2$ on the weight of the laminated sheet material. The resulting sheet material was dried at 160° F. (71° C.) for 21 seconds.

The dried sheet material was passed over an anti-wrinkle slat and then over a first ironing drum steam heated to a temperature of 200° F. (93° C.) and a second ironing drum steam heated to a temperature of 200° F. (93° C.).

The resulting sheet material had a lustrous satin-like appearance with rich red color on the acetate yarn face side and a red matte surface on the base layer side.

The sheet material was tested for break strength and elongation using ASTM Test Method D-828. The sheet material had a break strength of 50 lb/inch (8.9 kg/cm) width in the machine direction and 4.7 lb/inch (0.8 kg/cm) width in the cross-machine direction.

The sheet material was slit to 1 inch width and was tested for knot tie strength using ASTM Test Method D-828. The sheet material had a knot tie strength of 29.2 lbs/inch (5.2 kg/cm) width.

The sheet material was slit in 1" and ½" ribbon widths and a ribbon assembly of the type shown in FIG. 3 was made by sonically welding the points of attachment using a Bronson-Integrated ultrasonic welding system at a silver booster-gap setting of 3 mil (0.076 mm) on the anvil to provide a ⅛ inch (0.32 cm) pin seal. The strength of the pin seals were stress tested by severing the ribbon assembly on each side of a weld, 1 inch from the weld, removing the inner layers of the ribbon assembly, folding each outer layer such that the acetate filament surface contacts itself. The outer layer portions are pulled apart at the seal at a rate of 5 inches per minute. The sonic welds had an average stress value of 19.3 oz (547 g).

EXAMPLE 2

Sheet material was prepared as in Example 1 and slit to ½ inch (1.25 cm) width. A pressure-sensitive adhesive tape was prepared by applying to the base layer surface an adhesive transfer tape (No. 924, ½ inch (1.25 cm) wide, available from 3M Company) using an adhesive transfer gun applicator (No. ATG 752, available from 3M Company). The adhesive adhered well to the sheet material and provided an excellent decorative pressure-sensitive adhesive tape.

EXAMPLE 3

Sheet material was prepared as in Example 1. A 4-inch (10-cm) wide by 4-inch (10-cm) long piece of the sheet material was placed on a similar size piece of 8-point clay coated bending chipboard with the base layer surface of the sheet material in contamt with the cardstock. The sheet material was laminated to the cardstock using a press at a temperature of 225° F. (107° C.), a pressure of 90 lb/sq. inch (6.3 kg/cm$^2$), and a contact time of two seconds. The laminated decorative material was suitable for matchbook covers or greeting cards.

EXAMPLE 4

Sheet material, was prepared as in Example 1, was place in a vacuum former between a bottom aluminum male mold and a top urethane female mold. A rubber blanket was placed over the mold to enable a vacuum to be drawn. The sheet material was molded at 250° F. (120° C.) using a vacuum of about one atmosphere for ten seconds. The molded article, shown in FIG. 8 was suitable for use as a decorative medallion.

EXAMPLE 5

Sheet material was prepared as in Example 1. A 4-inch (10-cm) wide by 4-inch (10-cm) long piece of sheet material was placed on a press. A sheet of window screen was placed on each side of the sheet material. The screen/sheet material/screen sandwich was pressed at a temperature of 250° F. (120° C.) and a pressure of 90 lb/sq. inch (6.3 kg/cm$^2$) for 2 seconds to emboss the screen pattern into the surface of the sheet material. The sheet material was removed from the press. The embossed sheet material had the appearance of a woven fabric.

EXAMPLE 6

A base layer was produced as in Example 1, except that the base layer contained 14.1 g/m$^2$ "Melty" polyester binder fiber, 4.7 g/m$^2$ rayon fiber, and 8.0 g/m$^2$ "Rhoplex" P-376 thermobonding resin. Acetate filament yarns were laminated to the base layer as in Example 1 and the laminated sheet material was passed through an alcoholic dye/sizing bath containing about 5 weight percent vinyl sizing resin with solids pick-up of about 3.6 g/m$^2$ and then dried. The sheet material was slit in 1" and ½" ribbon widths and a ribbon assembly was formed using a ½"×1/16" bar seal made by a Branson bench model sonic welder, available from Branson Sonic Power Equipment Co., having a 401 actuator, a 900 watt, 190 p power source, a silver booster with a gain of 2 and a bar horn with a gain of 3 with the time and pressure indicated in Table 1. The seals were tested for peel strength by pulling the seals apart at a rate of 12 in/min. The peel strength of the seals are set forth in Table 1.

COMPARATIVE EXAMPLE 1

A fibrous web was prepared by blending cellulose acetate (3 denier, 4 cm long) and viscose rayon fibers (1.5 denier, 4 cm long) and applying thereto an aqueous emulsion of dimethoxyethyl phthalate plasticizer. The web was then dryed to form a fibrous base layer containing 8.9 g/m$^2$ acetate fiber, 6.5 g/m$^2$ plasticizer and 8.9 g/m$^2$ rayon fiber. The base layer was then brought into contact with acetate filament yarns (320 denier/90 filament/0 twist, type 3T-E000 bright, available from Celanese) and the acetate filament yarns were laminated to the base layer by pressing against a 160° C. heated drum. The laminated material was passed through an alcoholic sizing/dye bath containing 5 weight percent vinyl sizing resin with solids pick-up of about 3.6 g/m$^2$ and then dried. Ribbon assemblies were made as in Example 6. The seals of the ribbon assemblies were tested for peel strength as in Example 6, the results are shown in Table 1. None of the ribbon assemblies had adequate seal strength. When attempts were made to form bows from the ribbon assemblies, the seals broke and bows could not be formed.

TABLE 1

| Sonic Weld Conditions | | Peel Strength (oz) | |
|---|---|---|---|
| Pressure (psi) | Time (sec) | Experiment 6 | Comparative Experiment 1 |
| 15 | 0.1 | 20.1 | 0 |
| 15 | 0.4 | 20.8 | 0 |
| 15 | 1.0 | 19.7 | 0.1 |
| 15 | 6.0 | 21.1 | 1.5 |
| 40 | 0.1 | 20.0 | 0.1 |
| 40 | 0.4 | 19.5 | 2.6 |
| 40 | 1.0 | 21.2 | 5.6 |
| 40 | 2.0 | 21.1 | 9.9 |
| 40 | 3.0 | 21.1 | 9.3 |
| 40 | 6.0 | 23.0 | 8.6 |

Various modifications and alterations of this invention will become apparent to those skilled in the art without departing from the scope of this invention.

I claim:

1. Decorative sheet material comprising (a) a thermally bonded nonwoven tissue-like base layer having (i) a web of 20 to 90 weight percent thermally bondable polymeric staple fibers having a length of from about ¼ to 6 inches and 10 to 80 weight percent rayon staple fibers having a length of from about ¼ to 6 inches and (ii) 5 to 50 weight percent thermobonding resin based on the weight of the web, and (b) at least a monolayer of a multiplicity of substantially parallel continuous multifilament acetate yarns substantially covering a first side of said base layer and thermally laminated to said base layer, the second side of said base layer being sufficiently sonically sealable to a base layer of a second sheet material to form durable ribbon assemblies.

2. The decorative sheet material of claim 1 further comprising a protective sizing layer over said monolayer of filament yarns.

3. The decorative sheet material of claim 1 wherein said thermally bondable staple fibers are in the range of about 0.5 to 10 denier.

4. The decorative sheet material of claim 1 wherein said thermally bondable fibers are core-and-sheath-type fibers, said sheath having a melting point in the range of about 110° C. to 200° C.

5. The decorative sheet material of claim 4 wherein said fibers are polyester.

6. The decorative sheet material of claim 1 wherein said rayon staple fibers are in the range of from about 0.5 to 10 denier.

7. The decorative sheet material of claim 1 wherein said thermobonding resin is selected from acrylic, vinyl acrylic, styrene acrylic, ethylene vinyl acetate, and polyvinyl acetate resins.

8. The decorative sheet material of claim 7 wherein said thermobonding resin is acrylic resin.

9. The decorative sheet material of claim 2 wherein said sizing layer comprises vinyl resin.

10. The decorative sheet material of claim 1 wherein said acetate filament yarns are in the range of about 50 to 2500 total denier.

11. The decorative sheet material of claim 10 wherein each filament of said yarn has a denier in the range of between about 1 and 10.

12. The decorative sheet material of claim 1 wherein said base layer weighs in the range of 17 to 42 g/m$^2$.

13. The decorative sheet material of claim 1 wherein said continuous filament yarn weighs in the range of 30 to 84 g/m$^2$.

14. A decorative pressure-sensitive adhesive tape comprising the sheet material of claim 1 and pressure-sensitive adhesive on the side of said material opposite that having said filament yarns thereon.

15. A decorative ribbon comprising the material of claim 1.

16. A ribbon assembly comprising: first and second outer members of ribbon-width sheet material of claim 1, said outer members being spaced apart, longitudinally aligned, and of approximately the same length and having said base layers in face to face arrangement; spaced apart, thermally sealed, points of attachment along the longitudinal periphery of said outer members; at least one inner member extending the length of said outer members and residing within the space formed by said outer members and said points of attachment; and a thermally sealed end seal near one end of said inner and outer members which seals said members together, such that the end of said inner member distant said end seal can be held and said outer members can be slid along said inner member toward said end seal to form a decorative bow.

17. The ribbon assembly of claim 16 wherein said points of attachment have a peel strength of at least about 14 oz (397 g).

18. A laminated article comprising a fibrous substrate and a layer of the material of claim 1 over at least a portion of said substrate, said material being directly thermally bonded to said substrate.

19. A molded article comprising the material of claim 1.

20. An embossed article comprising the sheet material of claim 1 having a pattern embossed thereon.

21. A printed article comprising the sheet material of claim 1 having printing thereon.

22. A process for producing a decorative sheet material capable of being sonically bonded to a fibrous substrate comprising:

(a) forming a tissue-like nonwoven web of about 20 to 90 weight percent thermally bondable polymeric staple fibers having a length of from about ¼ to 6 inches and about 10 to 80 weight percent viscose rayon staple fibers having a length of from about ¼ to 6 inches, (b) coating said web with a solution of thermally bondable resin to provide 5 to 50 weight percent resin solids based on the weight of said web, (c) drying said coated web, (d) laying a multiplicity of parallel continuous multifilament acetate yarns on said coated web to substantially cover the surface of one side of said web, (e) heating said yarn covered web under sufficient temperature and pressure to cause said yarns to bond to said web.

23. The process of claim 22 further comprising applying a layer of sizing over said bonded yarns to protect the surface of said yarns.

24. The process of claim 22 wherein said process further comprises dyeing said sheet material.

* * * * *